United States Patent [19]

Rodosta et al.

[11] 4,152,795

[45] May 8, 1979

[54] BED ROCKING MECHANISM

[76] Inventors: John Rodosta, 7339 Canal Blvd.; Morris J. Weisler, 358 Sharon Dr., both of New Orleans, La. 70124

[21] Appl. No.: 862,022

[22] Filed: Dec. 19, 1977

[51] Int. Cl.[2] ..... A61G 7/06; A47D 9/04

[52] U.S. Cl. ..... 5/62; 5/109

[58] Field of Search ..... 5/108, 109, 61, 62, 5/60; 128/33

[56] References Cited

U.S. PATENT DOCUMENTS

| | | | |
|---|---|---|---|
| 2,808,828 | 10/1957 | Rubin | 128/33 |
| 3,247,528 | 4/1966 | Swenson et al. | 5/62 |
| 3,285,891 | 2/1966 | Chade et al. | 128/33 |
| 3,378,859 | 4/1968 | Parker | 5/109 |
| 4,006,499 | 2/1977 | Young | 5/62 |
| 4,071,916 | 2/1978 | Nelson | 5/109 |

*Primary Examiner*—Mervin Stein
*Assistant Examiner*—Alex Grosz
*Attorney, Agent, or Firm*—Francis J. Murphy

[57] ABSTRACT

Portable apparatus to impart a rocking motion to a bed includes a first and second supporting members disposable adjacent to the bed ends and first and second elongated members respectively mounted pivotable at their centerpoints on the first and second supporting members. The bed is mounted on the elongated members so that it is supported between them, and a source of reciprocating motion, such as a hydraulic cylinder, is connected to one end of at least one of the elongated members to impart a rocking motion to the bed.

10 Claims, 4 Drawing Figures

BED ROCKING MECHANISM

BACKGROUND OF THE INVENTION

Bedridden patients are often plagued by bed sores occurring on portions of their body which have been in prolonged contact with the bed surface. This condition can be alleviated or wholly prevented by periodically changing the relative position of the patient in the bed. In addition to alleviating the problem of bed sores, it is known that persons have a natural tendency to want to shift their position during periods of sleep and that they rest more comfortably when able to do so. Many patients because of the nature of their illnesses or injuries can not move in bed without assistance and this necessary motion must be provided either manually by members of the hospital staff or by mechanical means.

One means to periodically move bedridden patients would be to provide a mechanism which would rock the bed back and forth transversely causing motion of the patient on the bed. Mechanisms to provide this motion can be incorporated in the bed frame, as shown in U.S. Pat. Nos. 2,311,542 and 3,748,666. Doing this, however, greatly increases the cost of hospital beds as well as making such beds undesirably heavy and difficult to move. Since this rocking feature is not necessary for all hospital patients, it would be desirable to provide portable apparatus which can be attached to existing bed frames to provide this rocking motion selectively when and where needed for a particular patient at a particular time.

One approach to providing such a portable apparatus is found in copending U.S. application Ser. No. 768,910 now U.S. Pat. No. 4,080,673 which is a continuation of earlier application Ser. No. 631,626, now abandoned, both of which were filed by Morris J. Weisler, one of the inventors herein. The apparatus disclosed in these applications is more expensive and complex than the present apparatus because it requires two hydraulic cylinders for optimum operation. In addition, the flexible cables used to support the bed frame in these applications may not always provide enough support for a relatively heavy bed frame.

The present apparatus, by contrast, supports the bed between two beams which, in turn, are pivotably supported on a base. Additional support is provided by the fact that the bed legs extend through the bifurcated ends of the support beams to provide lateral support. A single hydraulic cylinder can provide the requisite rocking motion with this structure.

The device disclosed can be used with existing bed frames to provide a rocking motion when and where needed for a particular patient. This eliminates the need to transport heavy, bulky and unwieldy beds over great distances in a health care facility. Since the apparatus can be readily switched from bed to bed, there is no need to maintain a relatively large number of expensive beds having a rocking feature, many of which would be out of use at any given time.

SUMMARY OF THE INVENTION

Portable apparatus is provided to impart a rocking motion to a bed which includes a frame with first and second substantially opposed ends and supporting members attached to and extending downwardly from the frame. The apparatus includes first and second base members disposed respectively adjacent to the two ends of the bed and first and second elongated support members pivotably mounted on the respective base members at approximately their midpoints. Each of the elongated support members have bifurcated ends which define apertures adapted to receive the bed supporting members so that the elongated support members are respectively detachably connected to the first and second ends of the bed and the bed is supported between the elongated members. Reciprocating means are provided to periodically raise and lower at least one end of at least one of the elongated members to impart a periodic rocking motion to the bed.

DESCRIPTION OF THE PREFERRED EMBODIMENT

Figure 1:
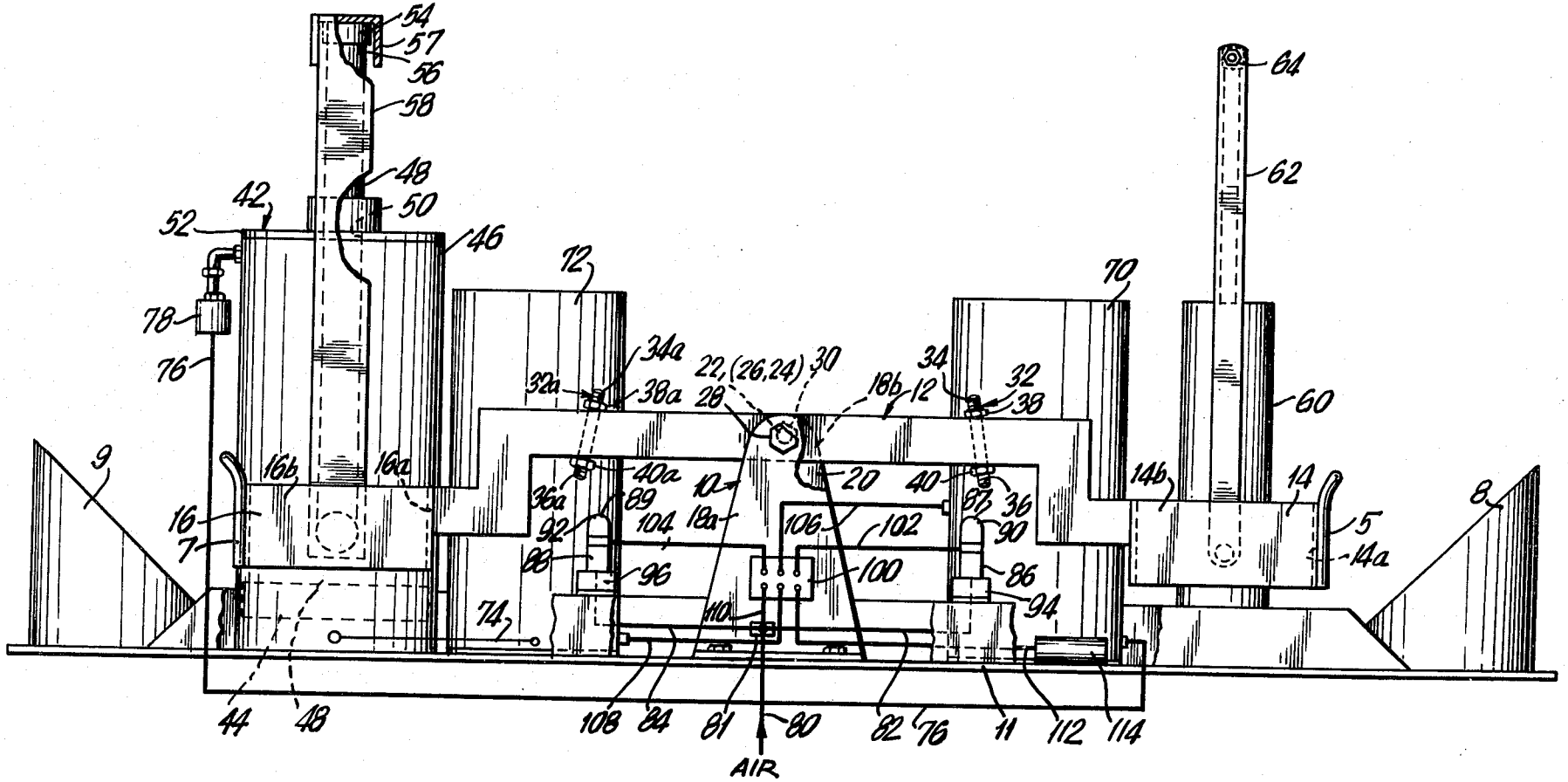
FIG. 1 shows an end view of the preferred embodiment of the bed rocking mechanism.

FIG. 1 shows an end view of the bed rocking mechanism which includes a base member 10 mounted on a base plate 11, and an elongated beam 12 serving as a support member. The ends of beam 12 terminate in bifurcated structures 14 and 16 defining recesses **14*a* and 16*a*. End closures 5 and 7 can be included to provide an enclosed recess which is configured to securely hold the legs at the corners of a hospital bed. If desired, shields 8 and 9 may be provided about the ends 14 and 16 of beam 12** to prevent accidental injury.

The upper portion of base 10 is also bifurcated to form sides **18*a* and 18*b* defining a central channel 20 which is configured to receive the beam 12. Aligned apertures 22 and 24 are provided in upper sides 18*a* and 18*b* of base 10 and an aperture 26 is provided at the midpoint of beam 12. A bolt 28 is placed through aligned apertures 22, 24 and 26 and is secured by nut 30. The bolt 28 forms a bearing surface on which the beam 12 is free to pivot in response to pressure applied to either of its ends 14 and 16**.

First and second rod-like actuators 32 and **32*a* are mounted through apertures in the beam 12 at points along the beam which are preferably equidistant from the pivot point of beam 12 which is defined by bolt 28. Actuators 32 and 32*a* may have threaded outer surfaces 34, 34*a*, 36, 36*a* on which nuts 38, 38*a*, 40 and 40*a*** can be threaded to hold the actuators in position and permit adjustment of their downward extension.

A hydraulic cylinder 42 includes a piston 44 movable within a cylinder 46. A piston rod 48 is connected to and movable with the piston 44 and extends out of the cylinder 46 through aperture 50 in end cover 52. A cylindrical collar 54 extends over the exterior end portion 56 of piston rod 48 to detachably mate with the piston rod 48. An arm 58 is connected to collar 54 and extends downwardly to a point where it is attached to end 16 of beam 12. For easy disassembly and transport, this connection can be made by a bolt extending through one branch **16*b* of bifurcated end 16 of beam 12. This connection alternatively can be made permanent by welding arm 58 to end member 16*a***.

A shock absorber 60 of the type well known in the art is attached to an arm 62 by bolt 64. Arm 62 is, in turn, attached to one of the arms 14*b* of bifurcated end 14. This shock absorber 60 provides a damping force to prevent rapid or irregular movement of beam 12. This provides a safety factor to stabilize the bed in the event of a hydraulic or air pressure failure.

First and second air and fluid reservoir tanks 70 and 72 are connected respectively to the top and bottom of cylinder 46 of hydraulic cylinder 42 by hydraulic lines 74 and 76. Both of the tanks 70 and 72 contain a hydraulic fluid which is forced through hydraulic lines 74 and 76 which are connected to the bottom of the tanks when air enters the top of the tanks through air lines 106 or 108. A needle valve 78 is connected in hydraulic line 76 to control the flow of hydraulic fluid into the top of hydraulic cylinder 46 and, if desired, to control the operating speed of hydraulic cylinder 46.

A source of compressed air 79 supplies air to the system at a suitable pressure such as 55 psi through air line 80 which connects to receiving block 81. Air lines 82 and 84 are respectively connected between switching block 81 and normally closed switchable valves 86 and 88. Switchable valves 86 and 88 include depressable buttons 87 and 89 which are arranged beneath and adjacent to beam 12 where they are contacted respectively by actuators 32 and 32*a* as beam 12 pivots on base 10. Mounting means such as brackets 94 and 96 are attached to base plate 11 and extend upwardly to support switchable valves 86 and 88 at a height such that depressable buttons 87 and 89 will be engaged respectively by actuators 32 and 32*a* when beam ends 14 and 16 reach their respective desired lowest points to momentarily open valves 86 and 88.

Figure 4:
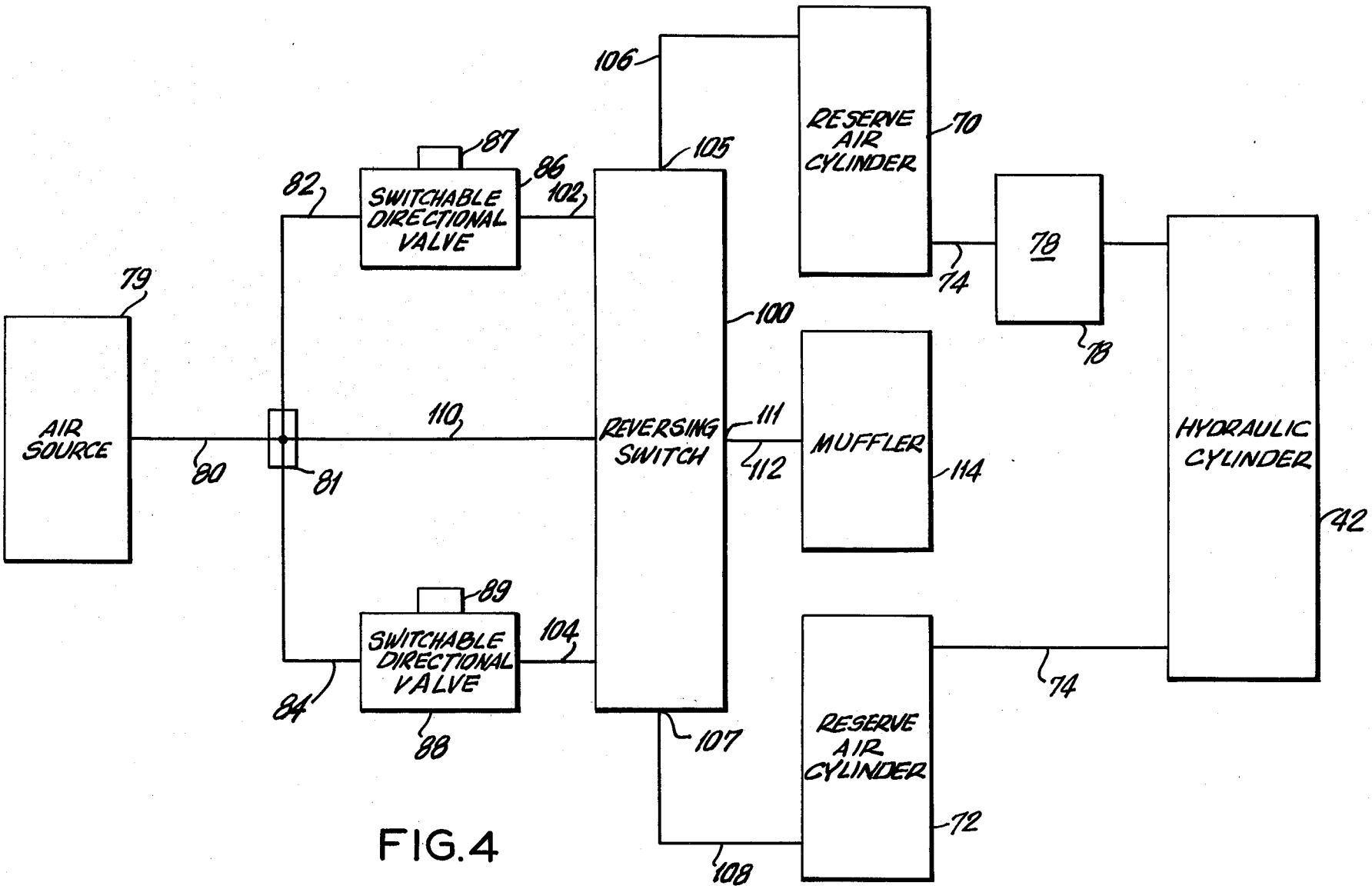
FIG. 4 shows a block diagram of the hydraulic circuit for the mechanism shown in detail in FIG. 1.

As can best be seen in FIG. 4, a reversing valve 100 is connected to switchable valves 86 and 88 by air lines 102 and 104, and is connected to the top of air and fluid reservoirs 70 and 72 by air lines 106 and 108 respectively. Air input line 80 is connected to reversing valve 100 through open air line 110 through receiving block 81. Air line 112 connects reversing valve 100 to a muffler 114. Muffler 114 is a device well known in the art and is used to prevent noise from escaping waste air.

Reversing valve 100 is well known in the art and is used to direct the incoming air from air line 110 to one of two outputs 105 or 107 depending upon the positioning of an internal slider valve. In a first position this valve opens a path from air line 110 to output 105 while in a second position that path is closed and an alternative path is provided from air line 110 to output 107. The internal slide valve is caused to switch between the first and second position when air pressure enters through air lines 102 or 104. If, for instance, air pressure is present at input line 102 the slider valve in reversing valve 100 moves so as to open a path between input air line 110 and output 105. Conversely when air pressure is present in input air line 104 the internal slider valve of reversing valve 100 cuts the air path to output 105 and opens the air path between air input line 110 and output 107.

The reversing valve also permits exhaust air to enter through ports 105 and 107. This exhaust air is directed through output 111, exhaust air line 112 and muffler 114 out of the system.

Figure 2:
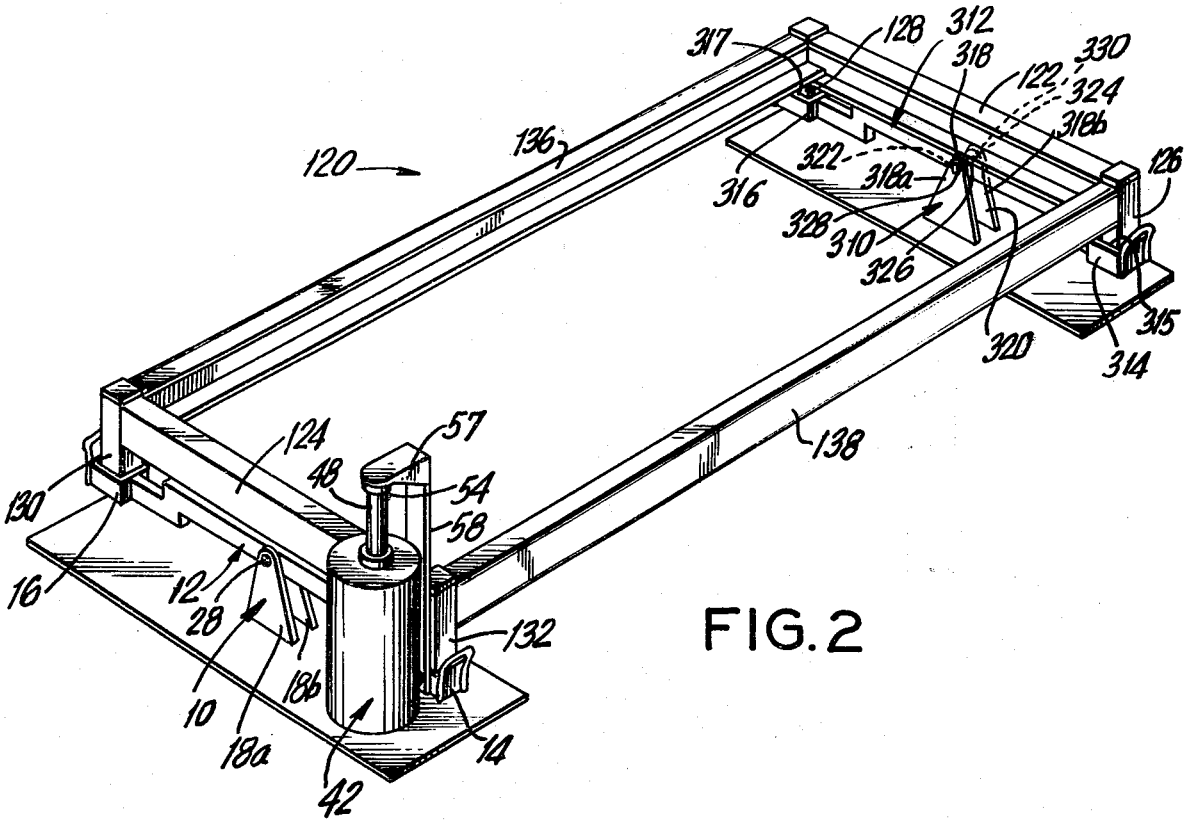
FIG. 2 shows a first arrangement of the supporting members connected to a bed frame with a hydraulic cylinder connected to one of the support members.

FIG. 2 shows a bed frame 120 having opposed ends 122 and 124. The bed frame 120 includes four supporting legs 126, 128, 130 and 132. These legs extend through the recesses formed by bifurcated ends 14 and 16 of support beam 12. As can be seen in FIG. 2, ends 14 and 16 of beam 12 have legs 130 and 132 of bed frame 120 extending into their end apertures to support end 124 of the bed so that the bed frame 120 will rock when beam 12 is pivoted on base member 10.

As shown in FIG. 2 the other end 122 of bed frame 120 must also be supported to prevent legs 126 and 128 from alternately banging on the floor as the bed is rocked. The end 122 is preferably supported by an idler apparatus including a second base member 310 having an upper portion 318 which is bifurcated so that upper arms 318*a* and 318*b* define a channel 320 which is configured so that a second beam 312 will move smoothly within this channel. Again, as at end 124, the upper end 318 of base member 310 has aligned apertures 322 and 324 in its upper arms 318*a* and 318*a* and a corresponding aperture 326 at the midpoint of beam 312. A bolt 328 is inserted through aligned apertures 322, 324 and 326, and is secured by bolt 330. The bolt 330 forms a bearing surface on which the beam 312 is free to pivot in response to pressure applied to either of its ends.

The ends 314 and 316 of beam 312 are again bifurcated to define recesses 315 and 317. Bed legs 126 and 128 are again insertable into the apertures 315 and 317. Longitudinal sides 136 and 138 of bed frame 120 act to link beams 12 and 312 when bed legs 126, 128, 130, and 132 are extending through the beam members. In this manner, bed frame 120 is supported off the floor. When pressure is applied to one end of one beam, such as end 16 of beam 12 by arm 58 which is activated by hydraulic cylinder 42, the resulting motion of bed end 124 is transmitted through bed frame longitudinal sides 136 and 138 causing the idler support mechanism including base 310 and pivoted beam 312 to follow the motion of driven beam 312 to provide a uniform rocking motion at both ends 122 and 124 utilizing a single hydraulic cylinder 42.

Figure 3:
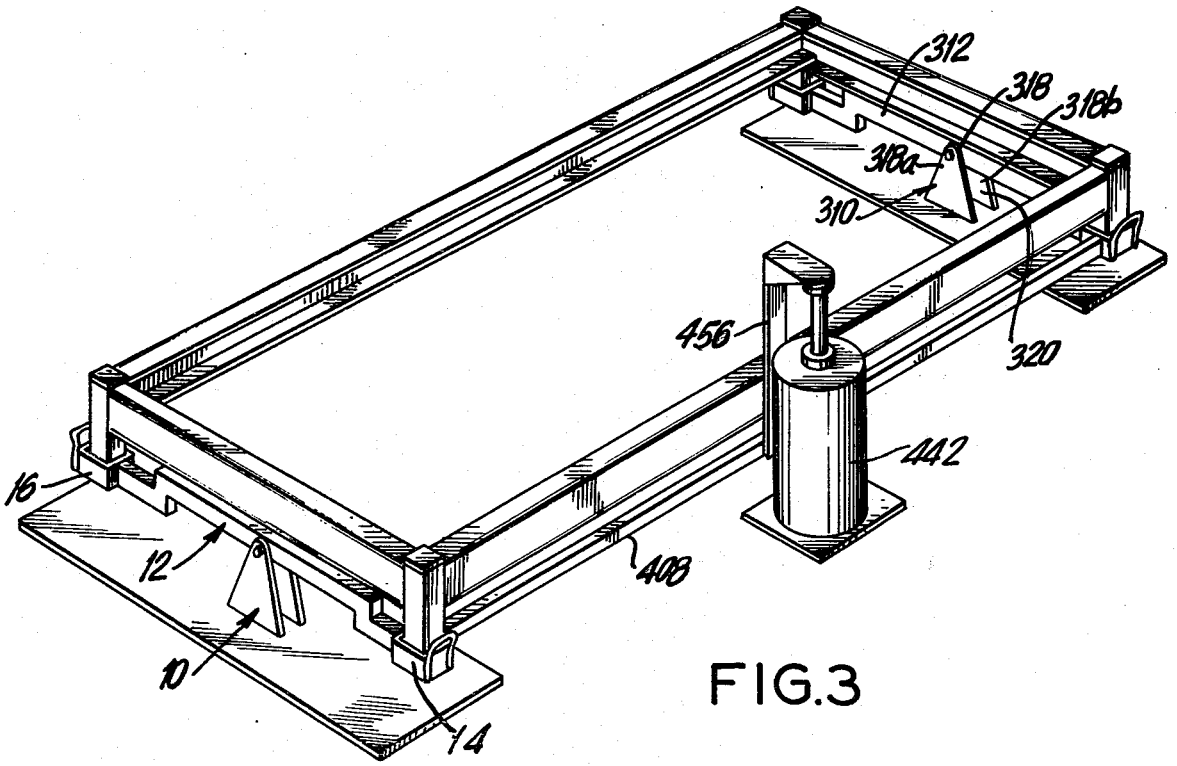
FIG. 3 shows a second arrangement of the supporting members with a beam linking the members and the hydraulic cylinder connected to the beam.

An alternative arrangement of the same component parts is shown in FIG. 3. In this version, a longitudinal strut 408 is connected between the ends 16 and 316 at the same longitudinal side of the bed. The hydraulic cylinder 442 is then attached by arm 456 to some point along strut 408 to apply force directly to ends 16 and 316 of beams 12 and 312.

The block diagram of FIG. 4 schematically shows the air pressure and hydraulic circuit of the apparatus. A source of compressed air 79 is connected by air line 80 to a receiving block 81 which in turn connects air source 79 to branching air lines 82, 84 and 110. Air lines 82 and 84 are connected to the respective inputs of switchable directional valves 86 and 88. These switchable valves 86 and 88 include respective depressable switch members 87 and 89. Air lines 102 and 104 link the outputs of switchable directional valves 86 and 88 to first and second inputs of a reversing switch 100. Airline 100 links air source 79 through the receiving block 81 to a third input of reversing switch 100. Air line 106 connects a first output of reversing switch 100 to the top of a first reserve air and hydraulic fluid cylinder 70 and air line 108 connects a second output of reversing switch 100 to a second reserve air and hydraulic fluid cylinder 72. Hydraulic line 76 connects the bottom of first reserve air and hydraulic fluid cylinder 70 to the upper end of hydraulic cylinder 42 through needle valve 78. Hydraulic line 74 connects second reserve air and hydraulic fluid cylinder 72 to the lower end of hydraulic cylinder 42. A muffler 114 is connected to a third output of reversing switch 100 by exhaust air line 112.

The operation of the apparatus will now be described. Prior to activation, bed frame 120 is maintained in a stable horizontal orientation by the action of shock absorber 60 which effectively damps any motion which would tend to cause beams 12 and 312 to pivot about bases 10 or 310. At activation, air line 80 is opened so that pressurized air can flow from source 79 through air line 80, receiving block 81 and lines 82 and 84 to normally closed switchable valves 86 and 88 and through air line 110 to reversing switch 100. To activate the apparatus, needle valve 78 is manually opened permitting the flow of hydraulic fluid through hydraulic line 76. Needle valve 78 may also be adjustable to vary the reciprocating rate of piston 44 in cylinder 46. Alternatively speed adjustment can be provided by the inclusion of a second needle valve in hydraulic line 76.

At activation the reversing switch 100 will direct the air input through line 110 to either output 105 or 107 depending on the orientation of its slider valve. Assuming arbitrarily that output 105 is open, air pressure will be applied through air line 106 into the top portion of reserve air and hydraulic fluid cylinder 70.

This will cause hydraulic fluid to be forced from the bottom of cylinder 70 through hydraulic line 76 and open needle valve 78 into the top of hydraulic cylinder 42. This in turn presses the piston 44 downwardly within cylinder 46, which causes piston rod 48, collar 54 and arm 58 to move downwardly. Downward motion of piston 44 forces hydraulic fluid out of the bottom of cylinder 46 through hydraulic line 74 into the bottom of reserve cylinder 72. Air is then forced out of top of reserve cylinder 72 through air line 108 into reversing switch 100, exhaust air line 112 and muffler 114.

Downward motion of arm 58 forces end 16 of beam 12 downwardly until end 36*a* of activator 32*a* contacts and depresses switch member 89 of switchable valve 88. This causes valve 88 to open momentarily and permits air from receiving block 81 to pass through air line 84 and 104 into input 103 of reversing switch 100. The air appearing at input aperture 103 of reversing switch 100 moves the reversing switch slider valve to close the air passage from air line 110 to output 105 and open the second output 107 of reversing switch 100 to permit air to flow through air line 108 into the top of second reserve air and hydraulic fluid cylinder 72.

As air from air line 108 enters the top of cylinder 72, hydraulic fluid is forced through hydraulic line 74 into the lower end of hydraulic cylinder 42. This flow of hydraulic fluid causes piston 44, piston rod 48 and connecting arm 58 to reverse their direction of motion and move upwardly. Arm 58 then pulls end 16 of beam 12 upwardly until end 36 of actuator 32 contacts and depresses switch member 87 of switchable directional valve 86 causing valve 86 to open momentarily to begin another cycle. As piston 44 moves upwardly in cylinder 46, exhaust hydraulic fluid is forced out of cylinder 42 through conduit 76, into the bottom of reserve cylinder 70 and exhaust air is forced out of the top of cylinder 70 through air line 106 into reversing switch 100 where it passes out through output 111 and exhaust air line 112, into muffler 114 and then out of the system. As the piston 44 moves downwardly in cylinder 46, air is exhausted from the system through air line 74, reserve air cylinder 72, air line 108, reversing switch 100, exhaust air line 112, and muffler 114.

If desired, the needle valve 78, which is used to actuate the apparatus, may be inserted in either of air lines 74 or 76 and may be used to control the speed of the piston 44 of the hydraulic cylinder 42, and thereby control the speed of the rocking motion imparted to beam 12 and bed frame 120. As the needle valve 78 is opened, the speed of the rocking motion increases. If the system should malfunction, the shock absorber 60 acts to damp the motion of beam 12 to prevent any sudden motion which could be injurious.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

I claim:

1. Portable apparatus for imparting a rocking motion to a bed which includes a frame with first and second substantially opposed ends and legs attached to and extending downwardly from said frame at each of said opposed ends, including:

first and second base members disposable respectively adjacent to said first and second substantially opposed ends of said bed;

first and second elongated support members pivotably mounted on said respective base members, each of said elongated support members having first and second opposed bifurcated ends, each of said bifurcated ends defining a recess adapted to receive one of said legs of said bed so that each of said ends of said bed is supported by one of said elongated member;

means to periodically raise and lower at least one end of at least one of said elongated support members to impart a periodic rocking motion to said bed;

first and second normally closed switchable valves;

first and second activating members attached to said elongated member such that said first and second activating members respectively contact and activate said first and second switchable valves when said elongated member is at first and second predetermined positions; and means responsive to the activation of either of said switchable valves to reverse the direction of motion of said elongated support member.

2. Portable apparatus as claimed in claim 1 including control means to control the speed of said rocking motion.

3. Portable apparatus as claimed in claim 1 including damping means to limit the maximum speed of said rocking motion of said elongated members.

4. Portable apparatus as claimed in claim 3 in which said damping means includes a shock absorber and a support structure to hold said shock absorber in a predetermined orientation with respect to one of said support members, a first end of said shock absorber being connected to a point adjacent to one end of said one of said elongated support members and the other end of said shock absorber being connected to said support structure.

5. Portable apparatus for imparting a rocking motion to a bed which includes a frame with first and second substantially opposed ends and legs attached to and extending downwardly from said frame at each of said opposed ends, including:

first and second base members disposable respectively adjacent to said first and second substantially opposed ends of said bed;

first and second elongated support member pivotably mounted on said respective base members, each of said elongated support members having first and second opposed bifurcated ends, each of said bifurcated ends defining a recess adapted to receive one of said legs of said bed so that each of said ends of said bed is supported by one of said elongated members;

a hydraulic cylinder having a cylinder, a piston, and a piston rod connected to said piston, said piston being reciprocatingly movable within said cylinder and said piston rod having a first end attached to said piston and a second end extending out of said cylinder; said second end of said piston rod being connected to at least one end of at least one of said elongated support members to cause said one elongated support member to pivot about said base member in response to the reciprocating motion of said piston;

a first and second hydraulic fluid reservoirs connected respectively to opposed ends of the cylinder of said hydraulic cylinder, each of said reservoirs being adopted to supply hydraulic fluid to said cylinder to cause said piston to move when pressurized fluid is supplied to said reservoir;

a reversing valve connectable to a source of pressurized fluid and to each of said hydraulic fluid reservoirs said reversing valve being adopted to supply said pressurized fluid alternately to said first and second reservoirs; and switch means attached to said reversing switch and responsive to the motion of said elongated member to cause said reversing vale to switch said supply of pressurized fluid from one to other of said hydraulic fluid reservoirs on a periodic basis.

6. Portable apparatus as claimed in claim 5 including damping means to limit the maximum speed of said rocking motion of said elongated members.

7. Portable apparatus as claimed in claim 6 in which said damping means includes a shock absorber and a support structure to hold said shock absorber in a predetermined orientation with respect to one of said support members, a first end of said shock absorber being connected to a point adjacent to one end of said one of said elongated support members and the other end of said shock absorber being connected to said support structure.

8. Portable apparatus as claimed in claim 5 including at least one needle valve connected between one of said hydraulic fluid reservoirs and said hydraulic cylinder.

9. Portable apparatus as claimed in claim 5 in which said switching means includes a first and second normally closed mechanically actuated valves connected respectively between said source of pressurized fluid and first and second inputs to said reversing valve and including activating members attached to said elongated members at predetermined positions such that such activating members will contact and actuate said first and second switchable valves when said elongated member has reached respectively first and second predetermined positions.

10. Portable apparatus as claimed in claim 5 in which said reversing valve includes a third output for exhaust air and further including a muffler connected to said third output of said reversing switch.

* * * * *